US008231001B2

(12) United States Patent
Boon et al.

(10) Patent No.: US 8,231,001 B2
(45) Date of Patent: Jul. 31, 2012

(54) VARIABLE DISPLAY

(75) Inventors: Jason Robert Boon, Appleton, WI (US); George Ikuya Nukuto, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 66 days.

(21) Appl. No.: 12/769,333

(22) Filed: Apr. 28, 2010

(65) Prior Publication Data

US 2011/0266183 A1 Nov. 3, 2011

(51) Int. Cl.
*B65D 85/00* (2006.01)

(52) U.S. Cl. ..... 206/459.1; 40/601; 40/665; 206/459.5

(58) Field of Classification Search ..... 206/459.1, 206/459.5; 40/611.07, 310, 311, 606.02, 40/624, 665, 664, 306, 111, 109, 633, 312, 40/601, 487, 488, 491, 525; 24/2.5, 17 A, 24/17 AP See application file for complete search history.

(56) References Cited

U.S. PATENT DOCUMENTS

| | | | | |
|---|---|---|---|---|
| 137,000 | A * | 3/1873 | Hunt | 24/17 A |
| 953,508 | A * | 3/1910 | Becker | 40/525 |
| 4,446,810 | A | 5/1984 | Bressi | |
| 5,964,741 | A | 10/1999 | Moder et al. | |
| 6,915,602 | B2 * | 7/2005 | Davis et al. | 40/299.01 |
| 2002/0153271 | A1 | 10/2002 | McManus et al. | |
| 2002/0194711 | A1 * | 12/2002 | Stampler | 24/300 |
| 2003/0102238 | A1 | 6/2003 | White et al. | |
| 2003/0120241 | A1 | 6/2003 | Sorebo et al. | |
| 2004/0172789 | A1 * | 9/2004 | Lehr | 24/17 AP |
| 2005/0137940 | A1 | 6/2005 | Lindsay | |
| 2005/0154365 | A1 | 7/2005 | Zander et al. | |
| 2005/0205435 | A1 * | 9/2005 | Loy | 206/37 |
| 2005/0235539 | A1 * | 10/2005 | Story | 40/633 |
| 2006/0071061 | A1 | 4/2006 | Velazquez et al. | |
| 2006/0151340 | A1 * | 7/2006 | Meister | 206/232 |
| 2007/0012519 | A1 | 1/2007 | Angielski | |
| 2007/0045144 | A1 | 3/2007 | Wheeler et al. | |
| 2007/0088623 | A1 | 4/2007 | Chin | |
| 2007/0090014 | A1 | 4/2007 | Wheeler et al. | |
| 2007/0144929 | A1 | 6/2007 | Minerath et al. | |
| 2008/0053924 | A1 | 3/2008 | Weirich | |
| 2009/0038196 | A1 * | 2/2009 | Grassia et al. | 40/665 |
| 2009/0197231 | A1 * | 8/2009 | Sosalla | 434/267 |

FOREIGN PATENT DOCUMENTS

| | | | |
|---|---|---|---|
| JP | 2000-187455 | A | 7/2000 |
| KR | 20-0427647 | Y1 | 9/2006 |
| WO | WO 2005/066923 | A1 | 7/2005 |

* cited by examiner

*Primary Examiner* — Mickey Yu
*Assistant Examiner* — Rafael Ortiz
(74) *Attorney, Agent, or Firm* — Randall W. Fieldback; David J. Arteman

(57) ABSTRACT

A package includes an outer structure and a variable display. The variable display includes a display band and a main band. The display band is rotatably connected with the main band and has a first display face and a second display face. The display band is joined to the outer structure via an anchor. The main band extends around the outer structure and is moveable from a first vertical position to a second vertical position. The first display face is visible and the second display face is concealed in the first position. The first display face is concealed and the second display face is visible in the second position. The vertical movement of the main band along the outer structure rotates the display band.

6 Claims, 5 Drawing Sheets

VARIABLE DISPLAY

BACKGROUND OF THE INVENTION

Packaging for consumer products often serves multiple purposes. For example, the packaging may describe the product located within the packaging, communicate the manufacturer of the product, and provide a convenient method for transporting multiple products. However, some consumers are embarrassed about certain products when those items are meant to manage personal conditions such as incontinence or menstruation. Therefore, manufacturers that provide products to manage these conditions have the challenge to provide packaging containing enough information for the consumer to confidently identify and choose the appropriate products at the retail shelf without making the consumer self-conscious during the rest of the shopping experience.

SUMMARY OF THE INVENTION

The present invention provides packaging that is both informative and discreet. Specifically, in one aspect, the present invention provides a package having an outer structure and a variable display. The variable display includes a display band and a main band. The display band is rotatably connected with the main band. The main band extends, at least partially, around the outer structure and is moveable from a first position to a second position. The movement of the main band along the outer structure rotates the display band.

In various embodiments, the display band may be joined to the outer structure with an anchor. In some embodiments, the display band defines a width and the anchor is comprised of an adhesive extending at least 50% the width.

In some embodiments, the main band is made of paperboard. In some embodiments, the display band is made of polymer film.

In various embodiments of this aspect, the display band has a first display face that is visible in the first position and concealed in the second position. The display band has a second display face that is concealed in the first position and visible in the second position. In various embodiments, the first display face includes a brand name and the second display face does not include a brand name.

In various embodiments, the outer structure includes a fixed display that is visible when the variable display is in the first position and is concealed by the variable display when the variable display is in the second position.

In some embodiments, the first display face includes a first language and the second display face includes a second language that is different than the first language.

In some embodiments, the first display face includes a promotional item and the second display face does not include a promotional item.

In some embodiments, the main band includes a second display band being rotatably connected with the main band wherein movement of the main band along the outer structure rotates the second display band.

In some embodiments the outer structure includes a product access opening wherein the variable display inhibits access to the product access opening when in the first position and allows access to the product access opening when in the second position.

In another aspect, the present invention provides a package having an outer structure and a variable display. The variable display includes a display band and a main band. The display band is rotatably connected with the main band and has a first display face and a second display face. The display band is joined to the outer structure via an anchor. The main band extends around the outer structure and is moveable from a first vertical position to a second vertical position. The first display face is visible and the second display face is concealed in the first position. The first display face is concealed and the second display face is visible in the second position. The vertical movement of the main band along the outer structure rotates the display band.

In some embodiments, the display band defines a width and the anchor is comprised of an adhesive extending at least 75% the width. In some embodiments, the main band is made of paperboard and the display band is made of poly film.

In some embodiments, the first display face includes a brand name and the second display face does not include a brand name.

In some embodiments, the outer structure includes a fixed display that is visible when the variable display is in the first position and is concealed by the variable display when the variable display is in the second position.

In some embodiments, the outer structure includes a product access opening wherein the variable display covers the product access opening when in the first position and allows access to the product access opening when in the second position.

In another aspect, the present invention provides a package having an outer structure and a variable display. The variable display includes a display band and a main band. The main band is moveable about the outer structure and defines an axis of rotation. The display band rotates about the axis of rotation as the main band is moved.

In various embodiments, the outer structure includes a first indicia and the display band includes a second indicia and wherein a single linear movement of the main band conceals the first indicia and reveals the second indicia.

DETAILED DESCRIPTION OF THE DRAWINGS

The present invention provides a package having a variable display. The variable display is adapted to move up and down or side to side on the package. As the variable display moves along the package, a display band revolves around a main band. When the display band is printed, the movement of the main band reveals new hidden graphics that can quickly and dramatically change the appearance of the package. Also, the physical movement of the main band relative to the package can conceal or reveal different elements that are printed on the panels of the package. This change of appearance can be used to hide the brand name, product descriptor, and other information that is needed at shelf but might embarrass a consumer in their shopping cart and at the register.

Figure 1:
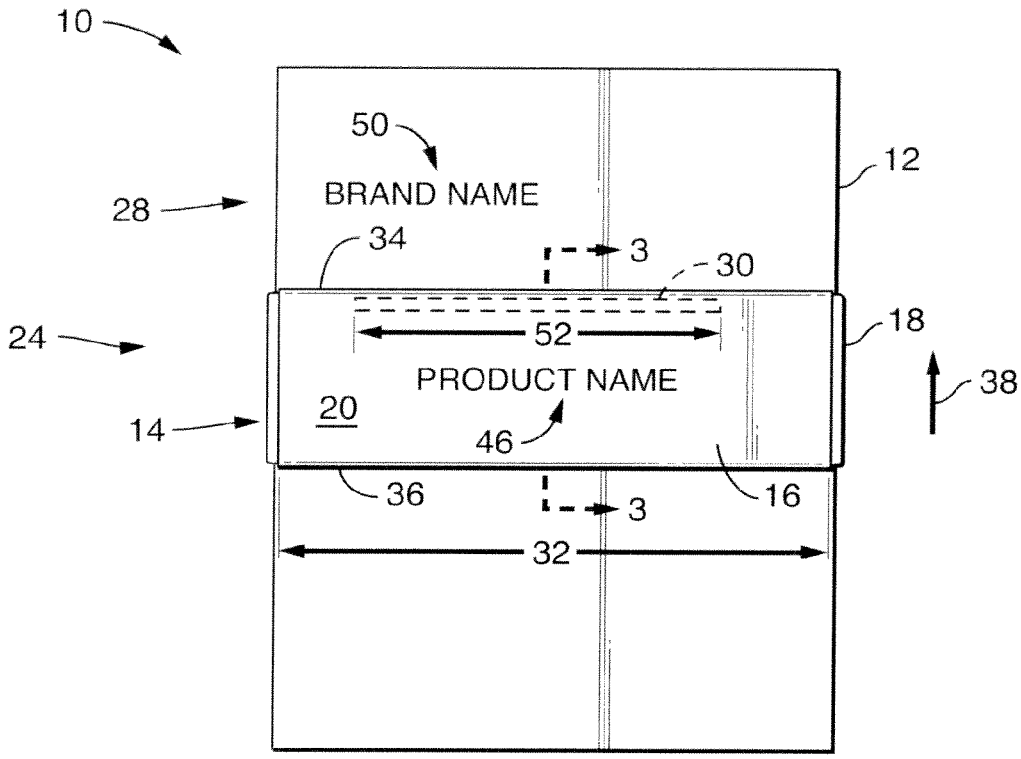
FIG. 1 representatively illustrates a front view of an exemplary package with a variable display in a first position.
Figure 2:
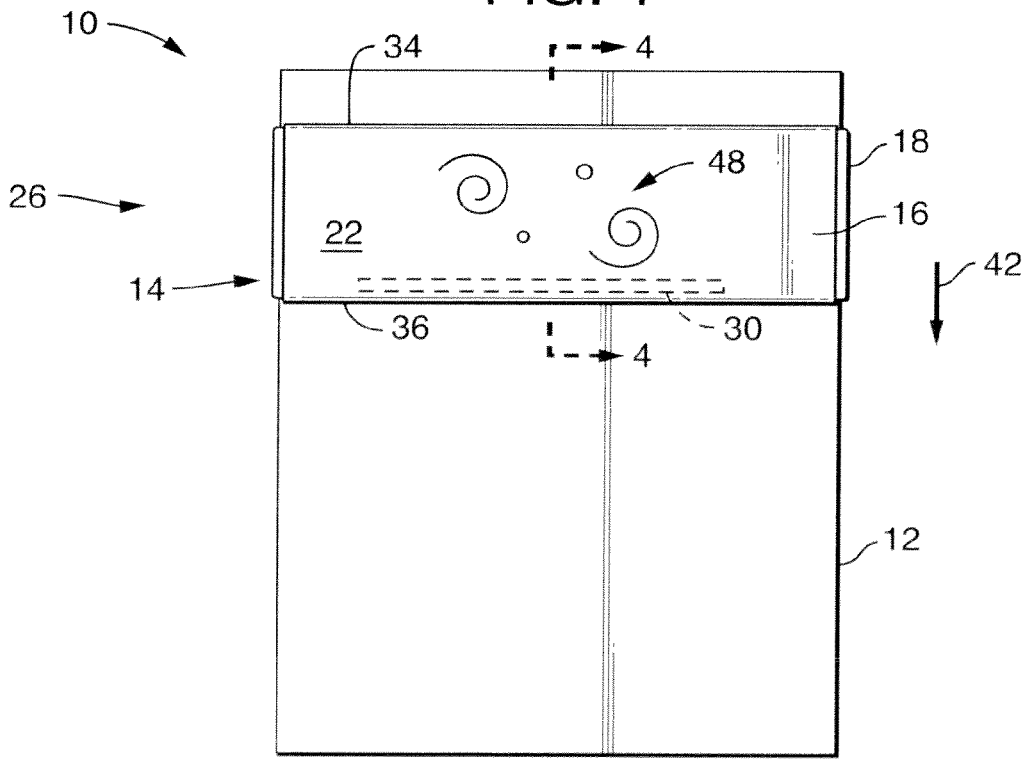
FIG. 2 representatively illustrates a front view of the package of FIG. 1 with the variable display in a second position.

Referring now to FIGS. 1 and 2, a front view of an exemplary package 10 is illustrated. The package 10 includes an outer structure 12 and a variable display 14. The variable display 14 includes a display band 16 and a main band 18. The display band 16 is rotatably connected with the main band 18. The main band 18 extends at least partially around the outer structure 12 and is moveable from a first position 24, as illustrated in FIG. 1, to a second position 26, as illustrated in FIG. 2. The movement of the main band 18 along the outer structure 12 causes the display band 16 to rotate.

Figure 3:
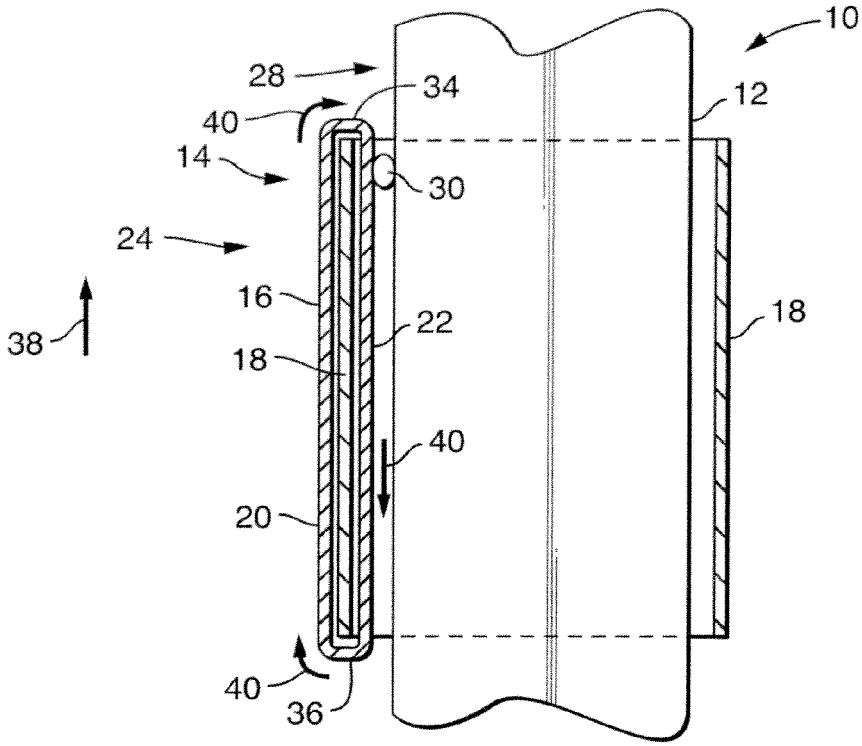
FIG. 3 representatively illustrates a cross-sectional view of the package of FIG. 1 taken along the line 3-3.
Figure 4:
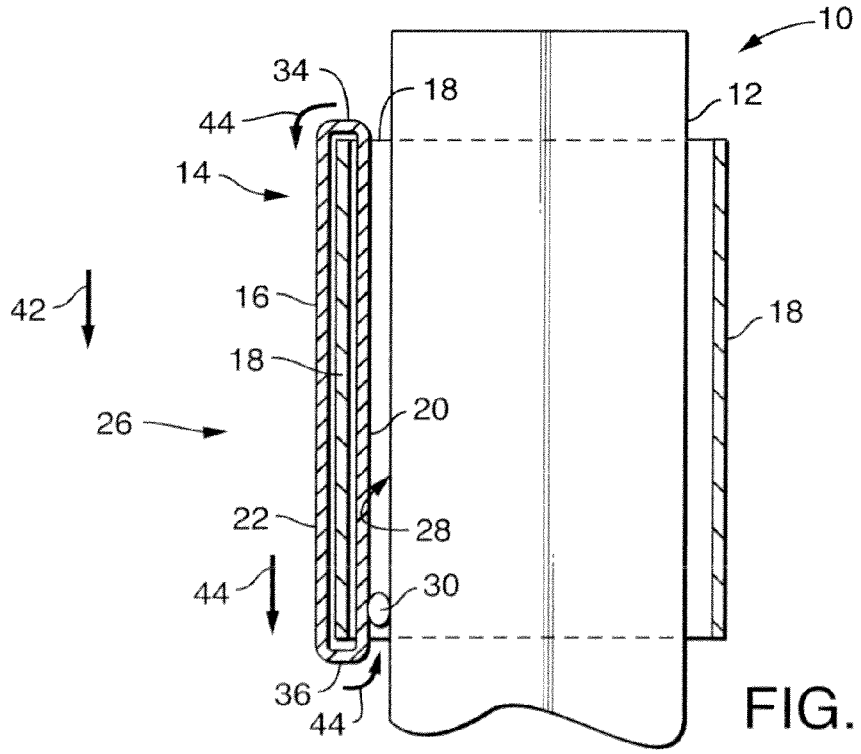
FIG. 4 representatively illustrates a cross-sectional view of the package of FIG. 2 taken along the line 4-4.

In various embodiments, the display band 16 defines a first display face 20 and a second display face 22 and is joined to the outer structure 12 with an anchor 30 as illustrated in FIGS. 3 and 4. FIG. 3 is a cross-sectional view of the package 10 of FIG. 1 taken along the line 3-3. Likewise, FIG. 4 is a cross-sectional view of the package 10 of FIG. 2 taken along the line 4-4. The variable display 14 defines a first position 24, a second position 26, a first edge 34, and a second edge 36.

Referring now to FIGS. 1 and 3, the variable display 14 is illustrated in the first position 24. In the first position 24, the anchor 30 is located proximate the first edge 34 of the variable display 14. In the first position 24, the first display face 20 of the display band 16 is visible to an observer looking at the package 10 and the second display face 22 is concealed from the observer. Additionally, in the first position 24, the main band 18 is adapted to move in a first direction 38. When the main band 18 moves in the first direction 38, the display band 16 rotates in a second direction 40 about the main band 18 until the variable display is in the second position 26.

Referring now to FIGS. 2 and 4, the variable display 14 is illustrated in the second position 26. In the second position 26, the anchor 30 is located proximate the second edge 36 of the variable display 14. In the second position 26, the first display face 20 of the display band 16 is concealed from an observer looking at the package 10 and the second display face 22 is visible to the observer. Additionally, in the second position 26, the main band 18 is adapted to move in a third direction 42. When the main band 18 moves in the third direction 42, the display band 16 rotates in a fourth direction 44 about the main band 18 until the variable display is in the first position 24.

As discussed above, the present invention allows for easy transition back and forth between the first position 24 wherein the first display face 20 is visible and the second position 26 wherein the second display face 22 is visible. As such, in some embodiments, the first display face 20 may include a first indicia 46, as illustrated in FIG. 1. In some embodiments, the second display face may include a second indicia 48, as illustrated in FIG. 2. In some embodiments, the outer structure 12 may include a fixed display 28. The fixed display 28 may include a third indicia 50 as illustrated in FIG. 1.

In various embodiments, the first indicia 46 and/or the second indicia 48 and/or the third indicia 50 may include any suitable design, graphic, pattern, texture, color, logo, text, brand name, product type, navigation guide, and the like, and combinations thereof. In some embodiments, the first indicia 46 may include a brand name and/or a product descriptor and the second indicia 48 may not include a brand name and/or a product descriptor. In these embodiments, the package 10 may be displayed at the retail shelf with the variable display 14 in the first position 24 and having the first display face 20 being visible to the consumer. The first display face 20 may include a brand name and/or a product descriptor as part of the first indicia 46. Thus, the consumer will be able to easily locate the desired package. Upon selection of the package 10, the present invention enables the consumer to move the main band 18 along the outer structure 12, which in turn rotates the display band 16, to effectively conceal the first indicia 46. In this configuration, the consumer may continue shopping or check out without advertising to others the brand name or type of product selected. This quick transformation provides the benefit of different information being displayed at different times to meet changing needs.

In some embodiments, the first indicia 46 may include a first language, such as English, and the second indicia 48 may include a second language, such as French, that is different than the first language. In these embodiments, the package 10 may be displayed at the retail shelf with the variable display 14 in either the first position 24 or the second position 26 depending on the desired language to be displayed.

In some embodiments, the first display face 20 and/or the second display face 22 may include a promotional item such as a coupon. In these embodiments, the variable display 14 may be positioned in either the first position 24 or the second position 26 depending on whether the promotion should be revealed or concealed.

In some embodiments, the third indicia 50 may be visible when the variable display 14 is in the first position 24 as illustrated in FIG. 1. In some embodiments, the third indicia 50 may be concealed by the variable display 14 when the variable display 14 is moved into the second position 26 as illustrated in FIG. 2. In these embodiments, the package 10 may be displayed at the retail shelf with the variable display 14 in the first position 24 and having the third indicia 50 visible to the consumer. The third indicia 50 may include a brand name and/or product type. Thus, the consumer will be able to easily locate the desired package. Upon selection of the package 10, the present invention enables the consumer to move the main band 18 along the outer structure 12 to effectively conceal the third indicia 50 as illustrated in FIG. 2.

In some embodiments, the first indicia 46 on the first display face 20 and the third indicia 50 in the fixed display 28 may be visible when the variable display 14 is in the first position 24 as illustrated in FIG. 1. In some embodiments, the first indicia 46 and the third indicia 50 may both be concealed by moving the variable display 14 into the second position 26 as illustrated in FIG. 2. In these embodiments, the package 10 may be displayed at the retail shelf with the variable display 14 in the first position 24 and having the first indicia 46 and the third indicia 50 visible to the consumer. The first indicia 46 and/or the third indicia 50 may include a brand name and/or product type. Thus, the consumer will be able to easily locate the desired package using the brand name and/or product type. Upon selection of the package 10, the present invention enables the consumer to move the main band 18 along the outer structure 12, which in turn rotates the display band 16, to effectively conceal both the first indicia 46 and the third indicia 50 with a single action.

In various embodiments, the outer structure 12 may be made of any suitable materials. For example, the outer structure 12 may be made of cardboard, card stock, paper, paper board, plastic, polymer film, woven material, non-woven material, metal, or the like, and combinations thereof. The outer structure 12 may define any suitable shape or size. The outer structure 12 may include any suitable number of sides. For example, the outer structure 12 may be a six-sided structure wherein the sides are generally joined together to form a hexahedron (See, e.g., FIG. 5). In some embodiments, the outer structure 12 may also include handles, gussets, opening features, flaps, folds, lids, lines of weakness, and the like, and combinations thereof.

In various embodiments, the anchor 30 may be any suitable means for joining the display band 16 to the outer structure 12. For example, the anchor 30 may include adhesive bonds, thermal bonds, pressure bonds, mechanical bonds, and the like, and combinations thereof. In various embodiments, the anchor 30 may have any suitable size and/or shape. For example, in some embodiments, the anchor 30 may include discrete bond areas, continuous bond areas, stripes, dots, and the like, and combinations thereof. In some embodiments, the display band 16 may define a width 32 and the anchor 30 may have an anchor width 52 that is at least 25%, at least 50%, or at least 75% the width 32 of the display band 16. For example, referring to FIG. 1, the anchor 30 is representatively illustrated as a continuous bead of adhesive having a width 52 that is about 65% of the width 32 of the display band 16.

In various embodiments, the main band 18 may be made of any suitable material. For example, the main band 18 may be made of cardboard, card stock, paper, paper board, plastic, acetate, polymer film, woven material, non-woven material, metal, or the like, and combinations thereof. In some embodiments, the main band 18 may be clear, opaque, or combinations thereof.

In various embodiments, the display band 16 may be made of any suitable material. For example, the display band 16 may be made of polymer film, nonwoven material, or the like, or combinations thereof. In various embodiments, the display band 16 may be printed, embossed, stamped, apertured, or otherwise worked, via various processes. In some embodiments, the display band 16 may be clear, opaque, or combinations thereof.

In various embodiments, the display band 16 may be rotatably connected to the main band 18 in any suitable manner. For example, the display band 16 may circumscribe the main band 18 and be joined to itself in any suitable manner. For example, the display band 16 may be joined to itself via adhesive bonds, thermal bonds, pressure bonds, mechanical bonds, and the like, and combinations thereof.

Figure 5:
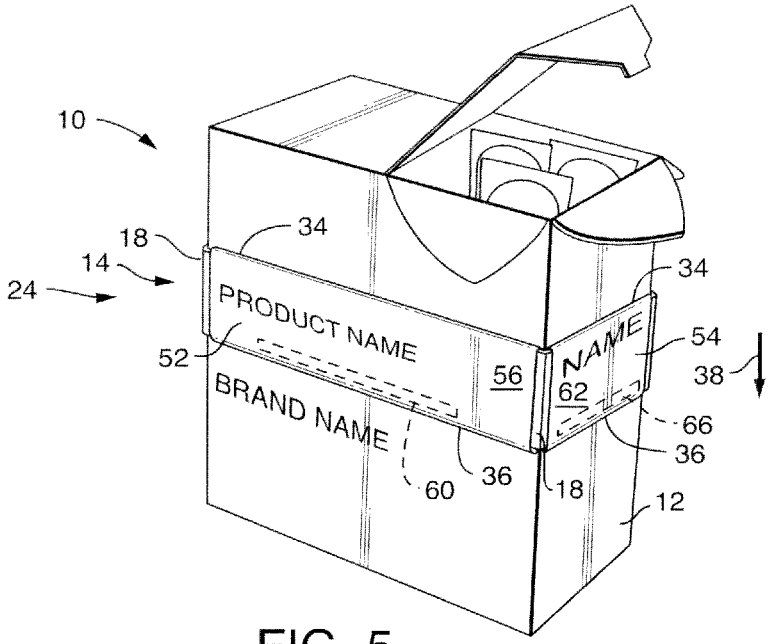
FIG. 5 representatively illustrates a front perspective view of an exemplary package with a variable display in a first position.
Figure 6:
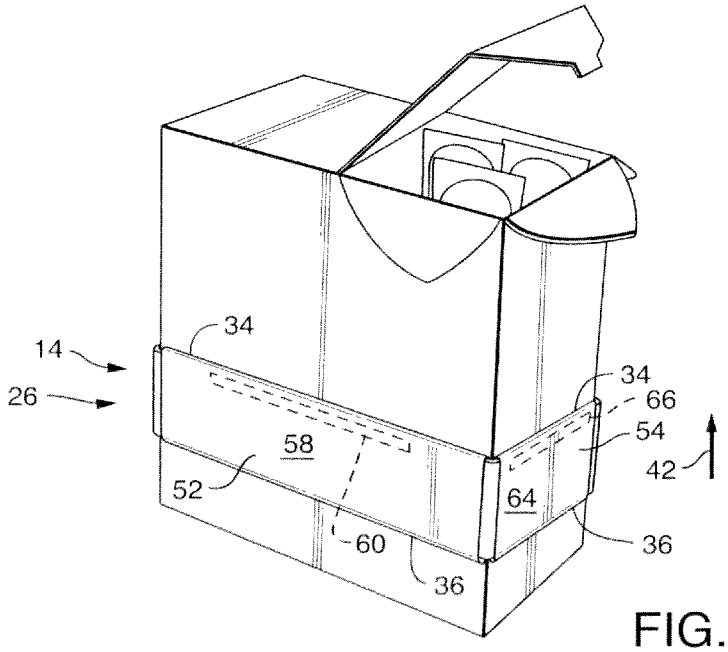
FIG. 6 representatively illustrates a front perspective view of the package of FIG. 5 with the variable display in a second position.

In some embodiments, the main band may include a first display band and a second display band being rotatably connected with the main band wherein movement of the main band along the outer structure rotates the first display band and the second display band. Referring now to FIG. 5, a perspective view of an exemplary package 10 is illustrated. The package 10 includes an outer structure 12 and a variable display 14. The variable display 14 includes a first display band 52, a second display band 54, and a main band 18. The first display band 52 is rotatably connected with the main band 18 and the second display band 54 is rotatably connected with the main band 18. The main band 18 extends at least partially around the outer structure 12 and is moveable from a first position 24, as illustrated in FIG. 5, to a second position 26, as illustrated in FIG. 6. The movement of the main band 18 along the outer structure 12 causes the first display band 52 to rotate around the main band 18 and causes the second display band 54 to rotate around the main band 18.

In various embodiments, the first display band 52 defines a first display face 56 and a second display face 58 and is joined to the outer structure 12 with a first anchor 60. Likewise, the second display band 54 defines a third display face 62 and a fourth display face 64 and is joined to the outer structure 12 with a second anchor 66. The variable display 14 defines a first position 24, a second position 26, a first edge 34, and a second edge 36.

In the first position 24, as illustrated in FIG. 5, the first anchor 60 and the second anchor 66 are located proximate the second edge 36 of the variable display 14. In the first position 24, the first display face 56 and the third display face 62 of the display band 16 are visible to an observer looking at the package 10 and the second display face 58 and the fourth display face 64 are concealed from the observer. Additionally, in the first position 24, the main band 18 is adapted to move in a first direction 38. When the main band 18 moves in the first direction 38, the first display band 52 and the second display band 54 rotate about the main band 18 until the variable display is in the second position 26.

Referring now to FIG. 6, the variable display 14 is illustrated in the second position 26. In the second position 26, the first anchor 60 and the second anchor 66 are located proximate the first edge 34 of the variable display 14. In the second position 26, the first display face 56 and the third display face 62 of the display band 16 are concealed from an observer looking at the package 10 and the second display face 58 and the fourth display face 64 are visible to the observer. Additionally, in the second position 26, the main band 18 is adapted to move in a third direction 42. When the main band 18 moves in the third direction 42, the first display band 52 and the second display band 54 rotate about the main band 18 until the variable display is in the first position 24.

Figure 7:
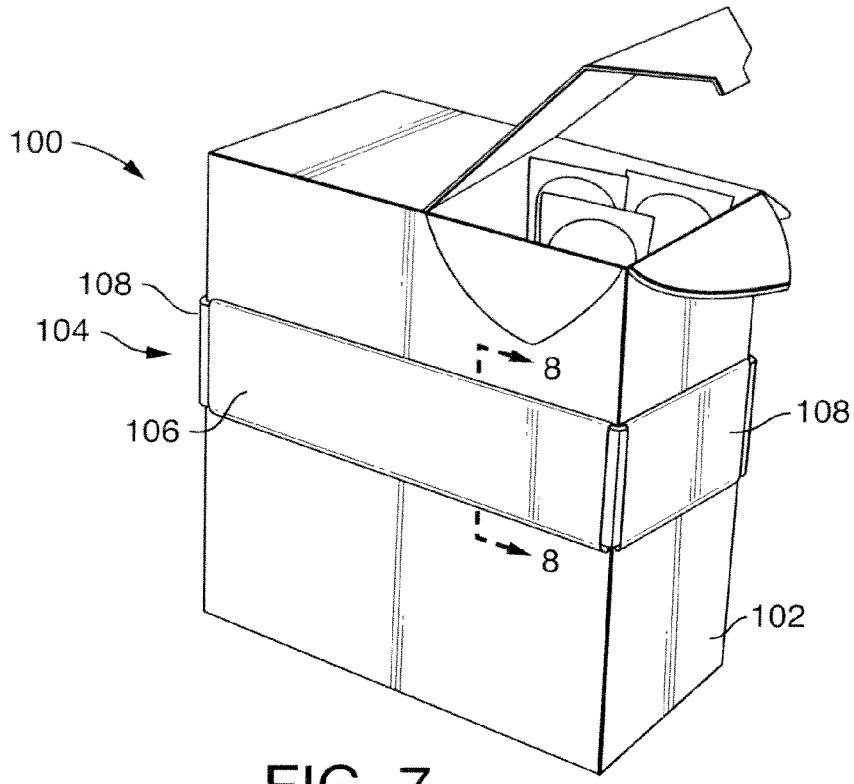
FIG. 7 representatively illustrates a front perspective view of an exemplary package with a variable display in a first position.
Figure 8:
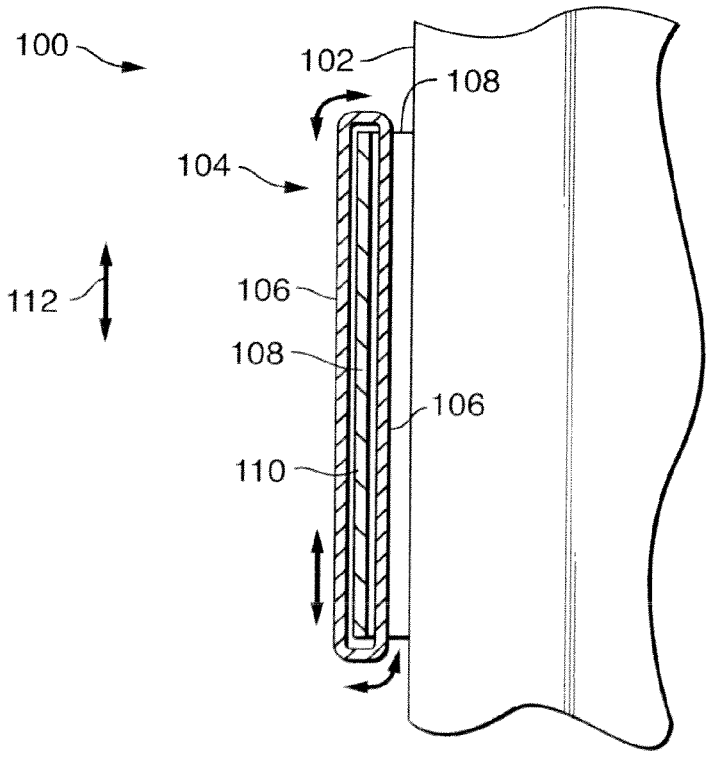
FIG. 8 representatively illustrates a cross-sectional view of the package of FIG. 7 taken along the line 8-8.

In some embodiments, the present invention provides a package having an outer structure and a variable display as illustrated in FIGS. 7 and 8. FIG. 7 is a front perspective view of a package 100 having an outer structure 102 and a variable display 104. FIG. 8 is a cross-sectional view of the variable display 104 of FIG. 7 taken along the line 8-8. Referring now to FIGS. 7 and 8, the variable display 104 includes a display band 106 and a main band 108. The main band 108 is moveable about the outer structure 102 and defines an axis of rotation 110. The display band 106 is associated with the main band 108 such that the display band 106 rotates about the axis of rotation 110 as a result of the main band 108 moving in a linear direction 112. The display band 106 may rotate about the main band 108 by any suitable means.

In these embodiments, the outer structure 102 may include a first indicia and the display band 106 may include a second indicia such that a single movement of the main band 108 conceals the first indicia and reveals the second indicia.

Figure 9:
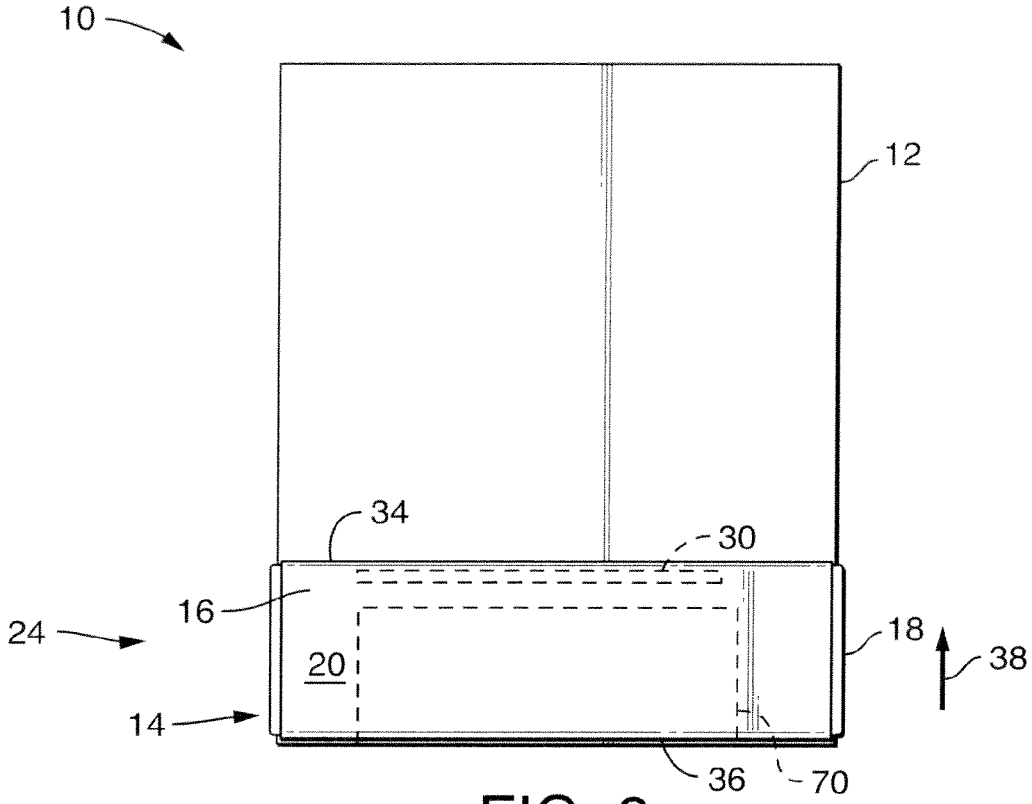
FIG. 9 representatively illustrates a front perspective view of an exemplary package with a variable display in a first position.
Figure 10:
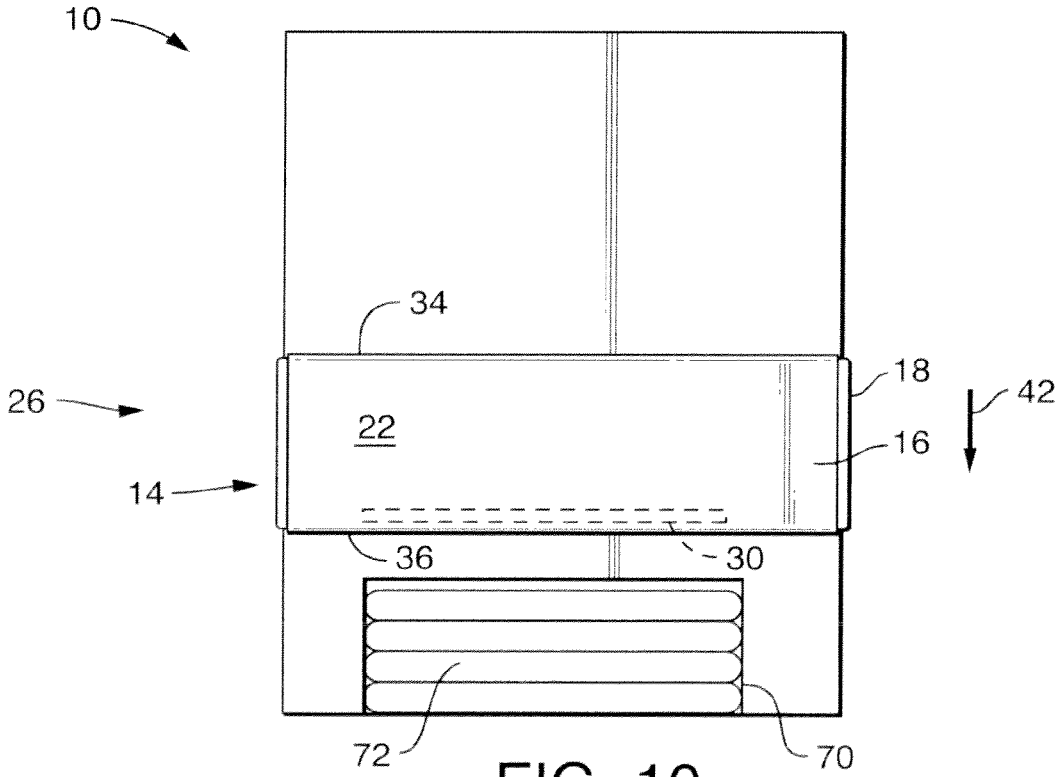
FIG. 10 representatively illustrates a front perspective view of the package of FIG. 9 with the variable display in a second position.

In some embodiments, a package may have a product access opening wherein the variable display at least partially covers the opening. Referring now to FIGS. 9 and 10, a front view of an exemplary package 10 is illustrated. The package 10 includes an outer structure 12 and a variable display 14. The variable display 14 includes a display band 16 and a main band 18. The display band 16 is rotatably connected with the main band 18. The main band 18 extends at least partially around the outer structure 12 and is moveable from a first position 24, as illustrated in FIG. 9, to a second position 26, as illustrated in FIG. 10. The movement of the main band 18 along the outer structure 12 causes the display band 16 to rotate. The outer structure 12 of the package 10 may also include a product access opening 70. The product access opening 70 may be any suitable opening that allows products 72 located within the package 10 to be accessed by a user.

In this embodiment, the display band 16 defines a first display face 20 and a second display face 22 and is joined to the outer structure 12 with an anchor 30. The variable display 14 defines a first position 24, a second position 26, a first edge 34, and a second edge 36. Referring now to FIG. 9, the variable display 14 is illustrated in the first position 24. In the first position 24, the anchor 30 is located proximate the first edge 34 of the variable display 14. In the first position 24, the first display face 20 of the display band 16 is visible to an observer looking at the package 10 and the second display face 22 is concealed from the observer. Additionally, in the first position 24, the main band 18 is adapted to move in a first direction 38. Also in the first position 24, the variable display 14 inhibits access to the products 72 via the product access opening 70.

When the main band 18 moves in the first direction 38, the display band 16 rotates about the main band 18 until the variable display is in the second position 26. Referring now to FIG. 10, the variable display 14 is illustrated in the second position 26. In the second position 26, the anchor 30 is located proximate the second edge 36 of the variable display 14. In the second position 26, the first display face 20 of the display band 16 is concealed from an observer looking at the package 10 and the second display face 22 is visible to the observer. Additionally, in the second position 26, the main band 18 is adapted to move in a third direction 42. Also in the second position 26, the variable display 14 allows access to the products 72 via the product access opening 70. When the main band 18 moves in the third direction 42, the display band 16 rotates about the main band 18 until the variable display is in the first position 24.

While the invention has been described in detail with respect to specific embodiments thereof, it will be appreciated that those skilled in the art, upon attaining understanding of the foregoing, will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A package comprising, an outer structure and a variable display, the outer structure comprises a product access opening that allows products located within the package to be accessed, the variable display comprising a display band and a main band, the display band being rotatably connected with the main band and having a first display face and a second display face, the display band being joined to the outer structure via an anchor, the main band extending around the outer structure and being moveable from a first position to a second position;

wherein the first display face is visible and the second display face is concealed in the first position;

wherein the first display face is concealed and the second display face is visible in the second position; and wherein movement of the main band along the outer structure rotates the display band.

2. The package of claim 1 wherein the display band defines a width and the anchor is comprised of an adhesive extending at least 75% the width.

3. The package of claim 1 wherein the main band is comprised of paperboard and the display band is comprised of poly film.

4. The package of claim 1 wherein the first display face includes a brand name and the second display face does not include a brand name.

5. The package of claim 1 wherein the outer structure includes a fixed display that is visible when the variable display is in the first position and is concealed by the variable display when the variable display in the in the second position.

6. The package of claim 1 wherein the variable display covers the product access opening when in the first position and allows access to the product access opening when in the second position.

* * * * *